US008027613B2

(12) United States Patent
Matsushita et al.

(10) Patent No.: US 8,027,613 B2
(45) Date of Patent: Sep. 27, 2011

(54) DEVELOPING DEVICE, PROCESS CARTRIDGE, AND IMAGE FORMING APPARATUS

(75) Inventors: Yuichi Matsushita, Nagoya (JP); Mitsuru Horinoe, Aichi-ken (JP); Yukiko Nakaya, Konan (JP); Hiroki Mori, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 1385 days.

(21) Appl. No.: 11/535,831

(22) Filed: Sep. 27, 2006

(65) Prior Publication Data

US 2007/0086805 A1 Apr. 19, 2007

(30) Foreign Application Priority Data

Sep. 28, 2005 (JP) ..... 2005-282634

(51) Int. Cl.
*G03G 15/08* (2006.01)

(52) U.S. Cl. ..... 399/102; 399/103

(58) Field of Classification Search ..... 99/102, 99/103

See application file for complete search history.

(56) References Cited

U.S. PATENT DOCUMENTS

| | | | |
|---|---|---|---|
| 5,987,277 | A | 11/1999 | Okabe |
| 6,321,050 | B1 | 11/2001 | Sato et al. |
| 6,336,014 | B1 | 1/2002 | Sato et al. |
| 6,763,209 | B2 | 7/2004 | Higeta et al. |
| 6,970,667 | B2 | 11/2005 | Watanabe et al. |
| 6,980,752 | B2 | 12/2005 | Kamimura |
| 2002/0028086 | A1 * | 3/2002 | Sato et al. ..... 399/103 |

FOREIGN PATENT DOCUMENTS

| | | | |
|---|---|---|---|
| JP | 08-146861 | | 6/1996 |
| JP | 08-202242 | A | 8/1996 |
| JP | 09-325608 | | 12/1997 |
| JP | 2000221777 | A | 8/2000 |
| JP | 2001022179 | A | 1/2001 |
| JP | 2001-060039 | | 3/2001 |
| JP | 2001134086 | A | 5/2001 |
| JP | 2003-140531 | | 5/2003 |
| JP | 2003-195628 | | 7/2003 |
| JP | 2004-151228 | | 5/2004 |
| JP | 2005-164675 | | 6/2005 |
| JP | 2005-200811 | | 7/2005 |

OTHER PUBLICATIONS

Notice of Reasons for Rejection for Japanese Application No. 2005-282634 mailed Jun. 17, 2008.

JP Notice of Reasons for Rejection: Patent Application No. 2005-282634, Dispatch No. 785321, Mailing Date: Jan. 6, 2009.

* cited by examiner

*Primary Examiner* — David Gray

*Assistant Examiner* — Erika J Villaluna

(74) *Attorney, Agent, or Firm* — Banner & Witcoff, Ltd.

(57) ABSTRACT

An arrangement of sealing members seals developer in a developer device. The sealing members minimize or eliminate developer from leaking around the sides of a developer carrier.

14 Claims, 11 Drawing Sheets

DEVELOPING DEVICE, PROCESS CARTRIDGE, AND IMAGE FORMING APPARATUS

CROSS REFERENCE TO RELATED APPLICATIONS

This application claims priority from Japanese Patent Application No. 2005-282634 filed on Sep. 28, 2005, the entire subject matter of which is incorporated herein by reference.

FIELD

Aspects of the present invention relate to developing devices for storing developer, such as toner, therein. Aspects of the invention also relate to process cartridges having the developing devices as well as image forming apparatuses having the process cartridges.

BACKGROUND

Laser printers print on recording media (for example, sheets of paper) using developers. The laser printer includes a case that stores developer. The case that stores the developer includes a case body. The case body has been formed with an opening. A developing roller is rotatably attached to the case body at a position facing the opening. The developing roller is configured to carry the developer stored within the case body. The laser printer includes a photosensitive member that contacts the developing roller. An electrostatic latent image is formed on a surface of the photosensitive member. The developing roller and the photosensitive member contact each other while rotating, so that the developer carried by the developing roller adheres to the electrostatic latent image on the photosensitive member. Thus, the electrostatic latent image on the photosensitive member is developed with the developer to form a visible image. The developer of the visible image is transferred from the photosensitive member to a recording medium, so that the recording medium is then printed with the developer in the shape of the visible image.

If the developer contained in the case body leaks outside of the case body, devices disposed around the case body may become contaminated. The case body needs to be designed such that the design prevents the leakage of the developer. In a related area, side seal members are used to protect the leakage of the developer from both ends of the developing roller with respect the axial direction of the developing roller. The case body includes an area facing a surface of the developing roller at each end with respect to an axial direction thereof. The side seal members are affixed to the area of the case body and contact the developing roller. Thus, each end of the developing roller is sealed in the developing roller's axial direction.

During operation, the side seal member contacts the developing roller, and a rotation force of the developing roller is transmitted to the side seal member. When the developing roller rotates, the side seal member is pressed inward with respect to the axial direction of the developing roller, and the side seal member is then moved inward. If the side seal member is moved inward, the ability of the side seal member to adequately seal the case may deteriorate. This deterioration increases the likelihood that the developer may leak from the case body.

SUMMARY

Aspects of the invention provide a developing device having higher sealing ability than conventional developing devices.

BRIEF DESCRIPTION OF THE DRAWINGS

Aspects of the invention will be described in detail with reference to various example structures and the following figures, wherein.

DETAILED DESCRIPTION

Aspects of the invention relate to a developing device that includes an improved design, thereby minimizing the likelihood of developer leaks.

It is noted that various connections are set forth between elements in the following description. It is noted that these connections in general and, unless specified otherwise, may be direct or indirect and that this specification is not intended to be limiting in this respect.

Figure 1A:
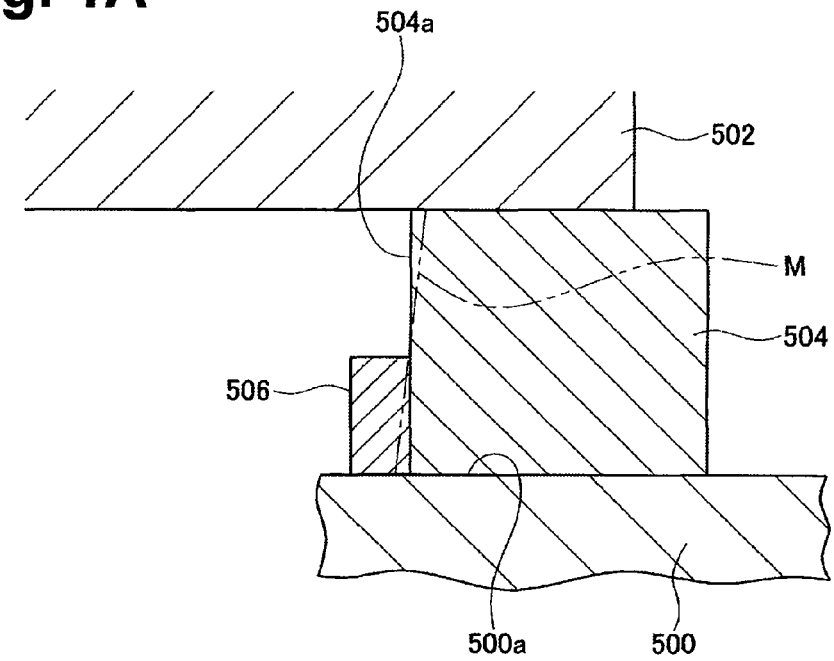
FIGS. 1A and 1B are sectional views showing a part of a developing device.
Figure 1B:
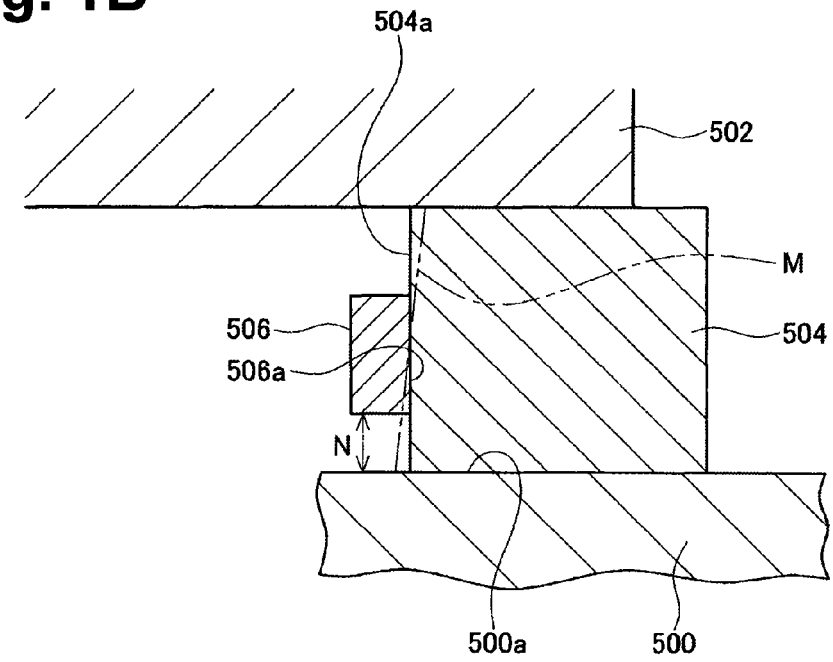

In accordance with one or more aspects of the present invention, as long as a contact member is provided in a case body so as to contact an inside surface of a side seal member, the side seal member can be prevented from moving inward even when it is pressed by a developing roller disposed in rotating contact with the side seal member. The inside surface of a side seal member is a side surface of the side seal member facing inward with respect to an axial direction of a developing roller. Referring to FIGS. 1A and 1B, one or more aspects of the present invention is described. FIG. 1A is a sectional view of a part of a developing device. The developing device has a case body 500 that is formed with an elongated opening and configured to store developer therein. The developing device includes a developing roller 502 disposed in the opening of the case body 500 and rotatably supported on the case body 500 at both ends. The developing roller 502 is configured to transport the developer. A side seal member 504 is affixed on the case body 500. The case body 500 includes an area 500*a* at each end of the case body 500. The area 500*a* faces each end portion of the circumferential surface of the developing roller 502 with respect to the developing roller 502's axial direction. The side seal member 504 is attached in the area 500*a* of the case body 500 and contacts the developing roller 502. The case body 500 includes a contact member 506 disposed in contact with an inside surface 504*a* of the side seal member 504 (with respect to the axial direction of the developing roller 502) at each end. Because of the contact member 506, the side seal member 504 can be prevented from moving inward (leftward in FIG. 1A).

The side seal member 504 is not rigid because the side seal member 504 needs to provide a sealing effect. The side seal member 504 can be manufactured by cutting a material that is not rigid. It is not easy to accurately make a straight cut in a material that is not rigid. Thus, the inside surface 504*a* of the side seal member 504 may be formed on a slant. The inside surface 504 of the side seal member 504 may be inclined outward (rightward in FIG. 1A), in a direction from the area 500*a* toward the developing roller 502, like a phantom line M in FIG. 1A. If the contact member 506 as shown in FIG. 1A is used for the side seal member 504 having the inside surface 504 inclined outward, a lower part of the side seal member 504 (a part close to the area 500*a* of the case body 500) and the contact member 506 may significantly interfere with each other. As a result, the side seal member 504 is greatly shifted outward (rightward in FIG. 1A). In this case, the side seal member contacts the developing roller at an unintended position, which may lower the sealing effect.

To prevent the lower part of the side seal member 504 and the contact member 506 from interfering with each other, a clearance N may be provided between the contact surface 506*a* of the contact member 506 and the area 500*a* of the case body 500 as shown in FIG. 1B. By providing clearance N in this way, if the inside surface 504*a* of the side seal member 504 is inclined like a phantom line M in FIG. 1B, the lower part of the side seal member 504 and the contact member 506 can be prevented from interfering with each other. Thus, the side seal member 504 can be prevented from moving outward.

According to one or more aspects of the invention, as the contact member is provided, the side seal can be prevented from moving inward. Furthermore, clearance can be provided between the contact surface of the contact member and the area of the case body, so as to prevent the side seal member from moving outward. According to one or more aspects of the invention, the side seal member can be prevented from contacting the developing roller in an unintended position. In this regard, the developing device may have a high sealing effect.

FIGS. 1A and 1B are views that describe the relative relationships between components in accordance with one or more aspects of the present invention. Each component should not be limited to shape and position shown in the figures. The technical scope of the invention should be interpreted based on the scope of the invention.

The case body of the developing device may include a layer thickness regulating member that is configured to regulate a thickness of developer carried on the developing roller. The layer thickness regulating member extends in the axial direction of the developing roller and regulates the thickness of developer on the developing roller over a substantially full range (or length) of the developing roller with respect to the axial direction. By regulating the thickness of the developer on the developing roller, a uniform thickness of developer can be supplied from the developing roller to the photosensitive member. Thus, a density of the developer to be transferred from the photosensitive member to a recording medium may be substantially uniform. The layer thickness regulating member may include an area facing the circumferential surface of each end portion of the developing roller with respect to the axial direction. Here, the side seal member may be affixed to cover fully from the area of the case body to the area of the layer thickness regulating member. A regulating member-side side seal member may or may not be provided independently from the side seal member. The regulating member-side side seal member may be affixed to the area of the layer thickness regulating member and contact the developing roller. Here, the side seal member and the regulating member-side side seal member contact each other so as to minimize or eliminate any gap between them in the rotation direction of the developing roller.

With any one of the above configurations, the side seal member may be affixed even to the area of the layer thickness regulating member, so that a wide range with respect to the rotation direction of the developing roller can be sealed, and thus the sealing effect may be improved.

The inside surface of the case-side seal member may shift inward toward a downstream side with respect to the rotational direction of the developing roller.

With this configuration, the sealing effect can be improved compared with a case where the inside surface of the case-side seal member shifts in an opposite direction of the above configuration.

One or more approaches described above may be embodied in the following developing device. The developing device may include a case body, a developing roller, a layer thickness regulating member, a regulating member-side seal member, and a contact member. The case body may be formed with an elongated opening and configured to contain developer therein. The developing roller may be disposed in the opening of the case body and rotatably supported on the case body at each end, with the developing roller configured to hold a layer of the toner thereon. The layer thickness regulating member may be fixed to the case body, extend in the axial direction of the developing roller, and be configured to regulate a thickness of the layer of the developer on the developing roller. The regulating member-side seal member may be attached to the layer thickness regulating member. The contact member is formed in the case body and has a contact surface contacting an inside surface of the regulating member-side seal member. The layer thickness regulating member includes an area facing a circumferential surface of the developing roller at an end portion of the case body with respect to an axial direction of the developing roller. The regulating member-side seal member is attached to the area of the layer thickness regulating and contacts the developing roller. A clearance is provided between the contact surface of the contact member and the area of the layer thickness regulating member.

With this configuration, the regulating member-side seal member can be prevented from shifting inward or outward. In addition, the regulating member-side seal member can be prevented contacting the developing roller in an unintended position. The developing device has high sealing effect.

When the contact member contacts the developing roller, it may be deformed during rotation of the developing roller. Thus, a clearance is provided between the contact member and the developing roller.

Non-magnetic, single-component polymerized toner easily leaks. The above developing device effectively functions as a case for storing such a toner that minimizes or eliminates leaks.

The developing device may be a developer cartridge configured to be received in and removed from an image forming apparatus, such as a copier, a laser printer, a facsimile, and a multifunction apparatus, which is configured to form an image using the developer.

A process cartridge may include the developing device. The process cartridge is configured to be received in and removed from an image forming apparatus configured to form an image using a developer. The process cartridge includes a photosensitive member and the developing device. The developer carried on the developing roller is supplied to a surface of the photosensitive member.

The process cartridge has high sealing effect, thereby minimizing or preventing leaks of the developer.

An image forming apparatus may include the developing device. The developer conveyed by the developing roller of the developing device is supplied to a surface of the photosensitive member. Next, the developer supplied to the surface of the photosensitive drum is transferred onto a recording medium.

In the image forming apparatus, as the developing device has high sealing effect, toner leakage can be minimized or prevented, and contamination by leaked developer may be minimized.

Figure 2:
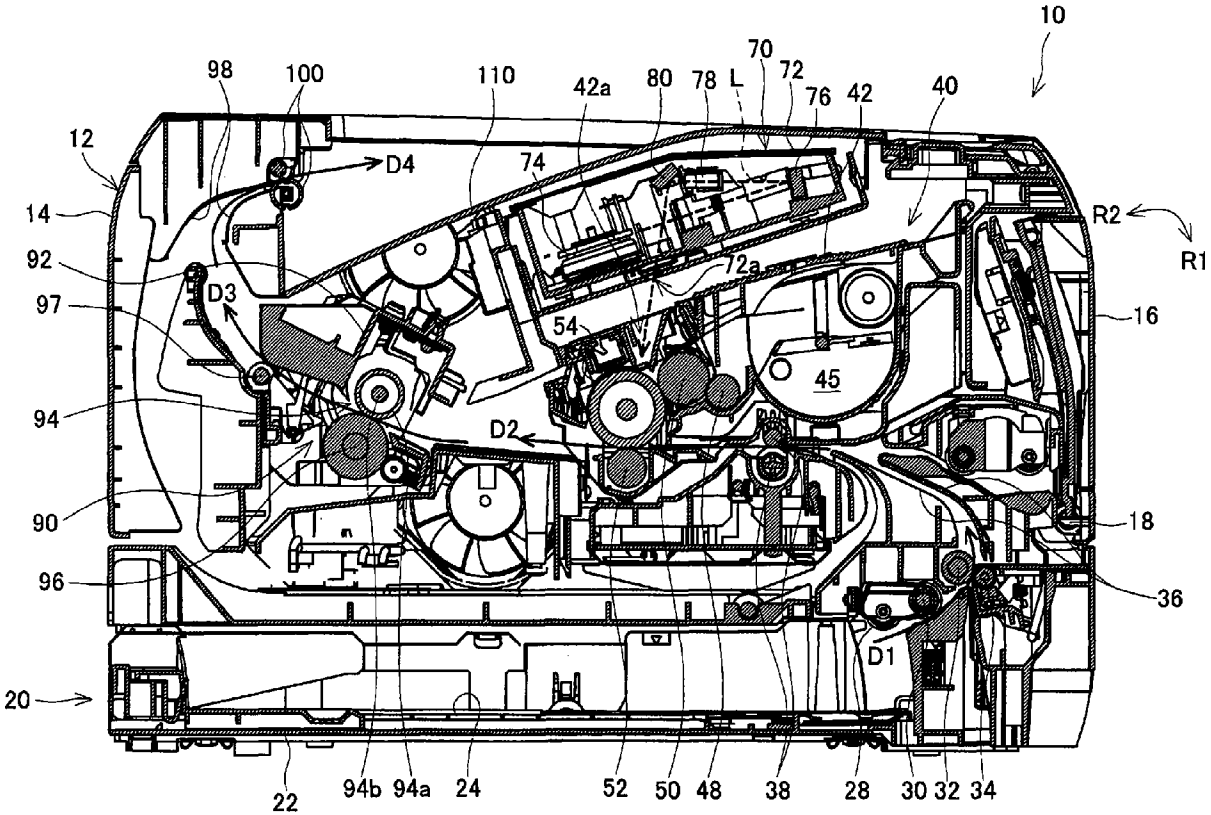
FIG. 2 is a sectional view of a laser printer according to at least one embodiment of the invention.

A first embodiment of the invention will be described with reference to the accompanying drawings. FIG. 2 is a sectional view of a laser printer 10 according to one or more embodiments of the invention. In the following description, the right side in FIG. 2 indicates a front side of the printer 10.

The printer 10 has a casing 12. The casing 12 is made up of a plurality of plate members. In FIG. 2, a rear cover member 14 and a front cover member 16 are shown as members constituting a part of the casing 12. The front cover member 16 is pivotal on a shaft 18 in directions of arrows R1 and R2. When the front cover member 16 is pivoted in the direction of arrow R1, the casing 12 is opened. In this state, a process cartridge 40, which will be described later, can be replaced. When the front cover member 16 is pivoted in the direction of arrow R2, the casing 12 is closed.

The printer 10 includes a sheet supply device 20, a process cartridge 40, a light exposure device 70, a toner fixing device 90, and other devices. The devices 20, 40, 70, and 90 are disposed inside the casing 12.

The sheet supply device 20 includes a paper tray 22 and four rollers 28, 30, 32, 34. Print sheets (sheets onto which the developer will deposited) (not shown) are loaded in the paper tray 22. The paper tray 22 has a bottom plate 24 on which a stack of print sheets is loaded. An uppermost sheet of the stack of the sheets loaded on the bottom plate 24 makes contact with a pick up roller 28. With the paper tray 22 set in the casing 12, a front end portion (on the right side of FIG. 2) of the bottom plate 24 is urged upward by a mechanism (not shown). Thus, when the stack of print sheets decreases in quantity, the bottom plate 24 is raised only at its front end portion. With this configuration, the uppermost sheet is allowed to normally contact the pickup roller 28.

The pickup roller 28 is connected to a drive source, not shown. The pickup roller 28 is capable of rotating counterclockwise. When the pickup roller 28 rotates, the uppermost sheet of the stack of the sheets loaded in the paper tray 22 is fed in the direction of arrow D1. The sheet fed in the direction of arrow D1 contacts a separation roller 30. The separation roller 30 is not connected to the drive source. The separation roller 30 is rotated counterclockwise by contact with the sheet. The separation roller 30 is configured to separate a single sheet from the stack when the stack reaches the separation roller 30 so as to feed the single sheet only to a downstream side. The sheet passed the separation roller 30 is fed to between the pinch roller 32 and the paper dust removing roller 34.

The pinch roller 32 and the paper dust removing roller 34 are not connected to the drive source. The pinch roller 32 is urged toward the paper dust removing roller 34 by an urging mechanism, not shown. The sheet interposed between the pinch roller 32 and the paper dust removing roller 34 is pressed toward the paper dust removing roller 34 by the pinch roller 32. A surface of the paper dust removing roller 34 is specially treated to remove foreign matter such as paper dust from the sheet in contact. The sheet from which paper dust is removed is fed along a rail 36 toward between two registration rollers 38.

The lower registration roller 38 is connected to the drive source, not shown. As the lower registration roller 38 rotates counterclockwise, the sheet is fed in the direction of arrow D2. The upper registration roller 38 is moved in contact with the sheet fed by the lower registration roller 38, and rotated clockwise.

When the sheet is fed in the direction of arrow D2 by the registration rollers 38, letters or images are printed on the sheet. Specifically, printing is made by the process cartridge 40, the light exposure device 70, and the toner fixing device 90.

The process cartridge 40 is detachable from the casing 12. When the front cover member 16 is opened in the direction of arrow R1, the process cartridge 40 can be removed from the casing 12. An old process cartridge 40 can be replaced with a new one.

The configuration of the process cartridge 40 will be described briefly. The process cartridge 40 has a casing 42. The casing 42 includes a through hole 42*a* at the top surface. A toner chamber 45 is formed on the right side inside the casing 12. Toner is contained in the toner chamber 45. On the left side inside the casing 42, three rollers 48, 50, 52, and a photosensitive drum 54 are disposed. Each of these rollers 48, 50, 52, and the photosensitive drum 54 is connected to the drive source, not shown. The rightmost roller 48 is a supply roller. On the left of the supply roller 48, a developing roller 50 is disposed. On the left of the developing roller 50, the photosensitive drum 54 is disposed. Under the photosensitive drum 54, a transfer roller 52 is disposed. The sheet fed by the registration rollers 38 in the direction of arrow D2 goes in between the photosensitive drum 54 and the transfer roller 52. The photosensitive drum 54 rotates clockwise and the transfer roller 52 rotates counterclockwise. With the rotation of the photosensitive drum 54 and the transfer roller 52, the sheet is fed further to the left in the direction of arrow D2. While the sheet is fed to the left, toner adhered on the photosensitive drum 54 is transferred onto the sheet.

The light exposure device 70 is disposed above the process cartridge 40. The light exposure device 70 is fixed to the casing 12. The light exposure device 70 has a casing 72. The casing 72 is formed at its lower surface with a through hole 72*a*. The light exposure device 70 includes a polygon mirror 74, a reflecting mirror 76, a lens 78, a reflecting mirror 80 and other optical elements in the casing 72*a*. The light exposure has a light source, not shown. A laser beam is emitted from the light source based on print data. The laser beam supplied from the light source is polarized at the polygon mirror 74, and directed to the reflecting mirror 76. The laser beam is reflected at the reflecting mirror 76, and passes through the lens 78. The laser beam passing through the lens 78 is further reflected at the reflecting mirror 80. The laser beam reflected at the reflecting mirror 80 comes from the through hole 72*a* outside the casing 72*a* and is directed downward. The laser beam coming out from the through hole 72*a* passes the through hole 42*a* and reaches the photosensitive drum 54. Thus, the photosensitive drum 54 is exposed to light with a predetermined pattern. Arrow L of FIG. 2 indicates a path of the laser beam.

The configuration of the toner fixing device 90 will be described. The toner fixing device 90 is disposed behind the process cartridge 40 (on the left side of FIG. 2). The toner fixing device 90 includes a frame 92, a heat roller 94, and a pressure roller 96. The heat roller 94 and the pressure roller 96 are rotatably supported in the frame 92.

The heat roller 94 has a metal tube 94*a* and a halogen lamp 94*b* disposed inside the metal tube 94*a*. The halogen lamp 94*b* heats the metal tube 94*b*. The heat roller 94 is connected to the drive source, not shown. When the drive source operates, the pressure roller 96 rotates clockwise. The pressure roller 96 is urged to the heat roller 94 by a mechanism, not shown. The pressure roller 96 is not connected to the drive source. When the heat roller 94 rotates clockwise, the pressure roller 96 follows the rotation of the heat roller 94 and rotates counterclockwise.

When the sheet passes through the process cartridge 40, it goes in between the heat roller 94 and the pressure roller 96. When the heat roller 94 rotates clockwise, the sheet, which is in between the heat roller 94 and the pressure roller 96, is fed to the left. The sheet is heated by the heat roller 94 that is heated to high temperature. Thus, toner transferred onto the sheet is fixed to the sheet by heat. The sheet passing through the toner fixing device 90 is fed in the direction of arrow D3.

A feed roller 97 is disposed just under the left end of the frame 92. The feed roller 97 is rotatably supported by the casing 12. The feed roller 97 is connected to the drive source, not shown. The feed roller 97 rotates counterclockwise. The feed roller 97 feeds the sheet passing through the toner fixing device 90 further toward the upper left. The sheet fed toward the upper left by the feed roller 97 is fed toward the right along rails 98.

Two ejection rollers 100 are disposed on the right side of the rail 98. The lower ejection roller 100 is connected to the drive source, not shown. The lower ejection roller 100 rotates clockwise. The upper ejection roller 100 is not connected to the drive source. When the lower ejection roller 100 rotates clockwise, the upper ejection roller 100 follows the rotation of the lower ejection roller 100 and rotates counterclockwise.

The sheet fed by the feed roller 97 goes in between the two ejection rollers 100. When the lower ejection roller 100 rotates clockwise, the sheet, which is in between the two ejection rollers 100, is fed toward the right. The sheet is fed outside the casing 12. An output tray 110 is formed on the upper surface of the casing 12. The sheet fed outside the casing 12 is ejected onto the output tray 110.

Figure 3:
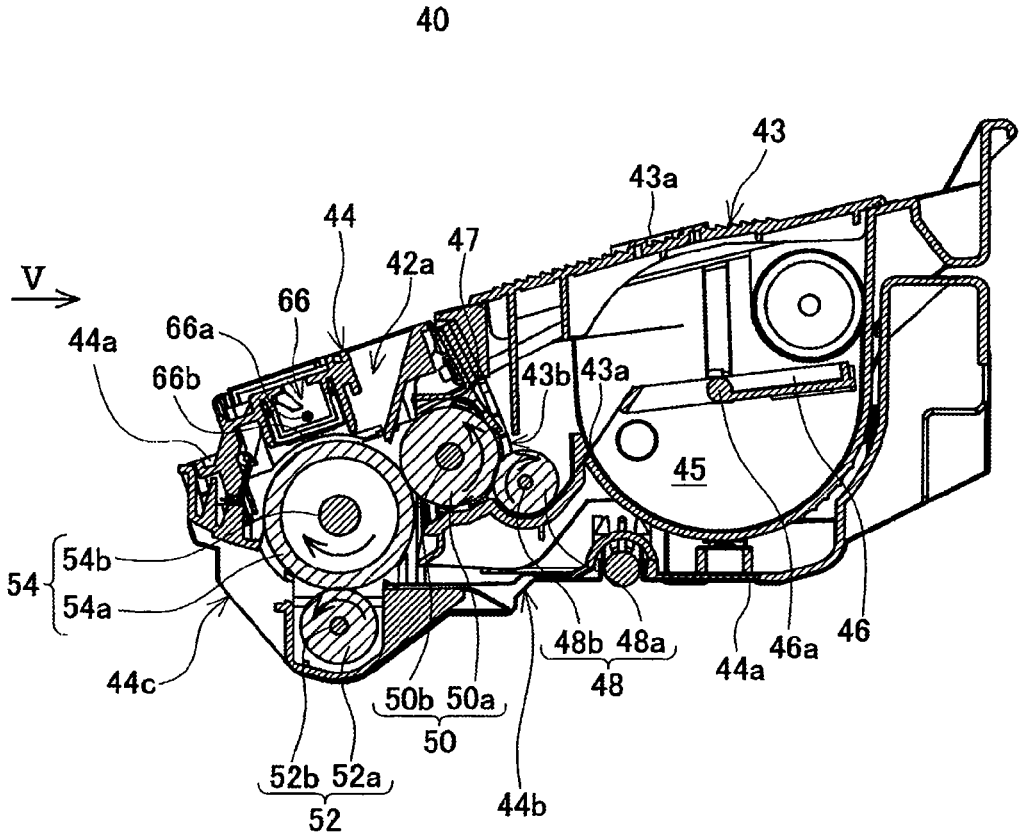
FIG. 3 is an enlarged sectional view of a process cartridge in accordance with one or more aspects of the present invention.

With reference to FIG. 3, the configuration of the process cartridge 40 will be described in detail. FIG. 3 shows an enlarged sectional view of the process cartridge 40.

Figure 4:
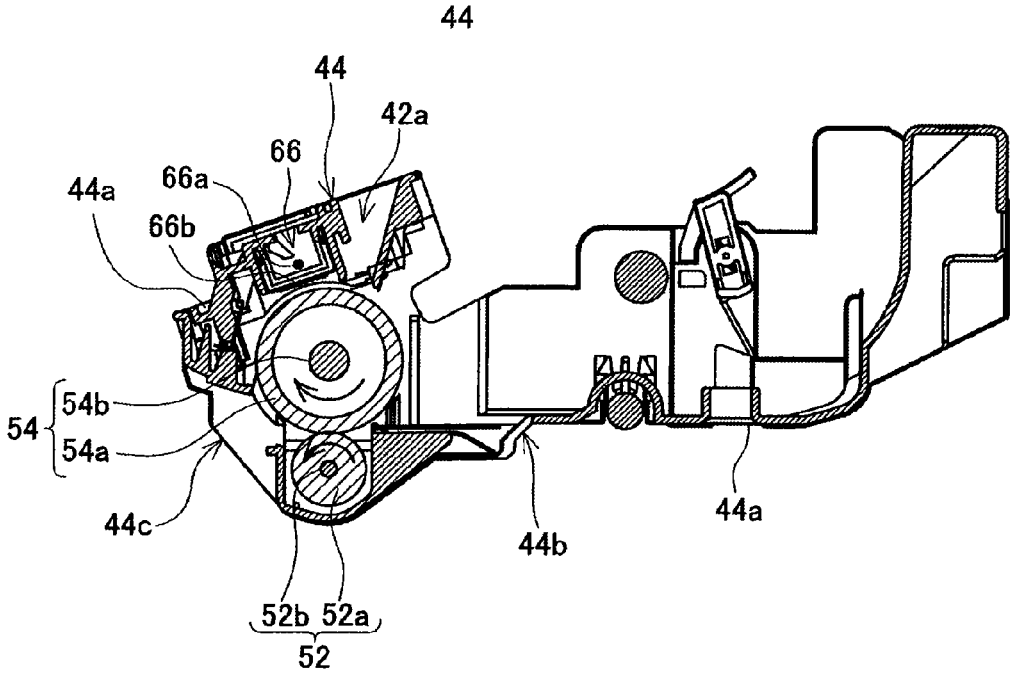
FIG. 4 is a sectional view of a photosensitive member cartridge in accordance with one or more aspect of the present invention.

The process cartridge 40 is made up of two cartridges 43 and 44. The right cartridge 43 is a developer cartridge. The left cartridge 44 is a photosensitive member cartridge. The developer cartridge 43 and the photosensitive member cartridge 44 are detachably connected to each other. FIG. 4 shows a sectional view of the photosensitive member cartridge 44 after the developer cartridge 43 is removed. According to the process cartridge 40, only the developer cartridge 43 can be replaced with a new one whereas only the photosensitive member cartridge 44 can be replaced with a new one. The process cartridge 40 can be replaced as a whole with a new one.

The configurations of the two cartridges 43 and 44 will be described. First, the configuration of the photosensitive member cartridge 44 will be described. The photosensitive member cartridge 44 has a casing 44*a*. The casing 44*a* is formed at its upper surface with a through hole 42*a* through which a laser beam passes. The casing 44*a* is formed at its lower surface with an incoming hole 44*b* through which a sheet goes in the photosensitive member cartridge 44. The casing 44*a* is formed at its left side surface with an outgoing hole 44*c* through which the sheet goes out from the photosensitive member cartridge 44. The sheet goes in the photosensitive member cartridge 44 from the incoming hole 44*b*, passes between the photosensitive drum 54 and the transfer roller 52, and goes out from the outgoing hole 44*c*.

The photosensitive drum 54, the transfer roller 52, and the charger 66 are disposed in the casing 44*a* of the photosensitive member cartridge 44.

The photosensitive drum 54 is disposed in contact with the developing roller 50 at the left thereof. The photosensitive drum 54 includes a photosensitive drum body 54*a* and a photosensitive drum shaft 54*b*. The photosensitive drum body 54*a* has a cylindrical shape, and is a positively charged photosensitive member. The surface of the photosensitive drum body 54*a* is made of polycarbonate. The photosensitive drum shaft 54*b* is made of metal. The photosensitive drum shaft 54*b* is fixed to the casing 44*a* of the photosensitive member cartridge 44. The photosensitive drum body 54*a* is rotatably attached to the photosensitive drum shaft 54*b*. The photosensitive drum body 54*a* is connected to the drive source, not shown. The photosensitive drum body 54*a* rotates clockwise.

The transfer roller 52 is disposed in contact with the photosensitive drum 54 from beneath. The transfer roller 52 includes a transfer roller body 52*a* and a transfer roller shaft 52*b*. The transfer roller body 52*a* is made of a conductive rubber material. The transfer roller shaft 52*b* is made of metal. The transfer roller shaft 52*b* is rotatably attached to the casing 44*a* of the photosensitive drum 44. The transfer roller shaft 52*b* is connected to the drive source, not shown. The transfer roller 52 rotates counterclockwise. The transfer roller shaft 52*b* is connected to a voltage supply circuit, not shown. During image transfer (when toner adhered to the photosensitive drum 54 is transferred onto the sheet), a bias is applied from the voltage supply circuit to the transfer roller 52.

The charger 66 is disposed above the photosensitive drum 54. There is a clearance between the charger 66 and the photosensitive drum 54. The charger 66 is a scorotron charger. The charger 66 has a charging wire 66*a* and a grid 66*b*. The charging wire 66*a* extends in a direction perpendicular to the sheet of FIG. 3. The charging wire 66*a* receives a high voltage. The grid 66*b* is disposed between the charging wire 66*a* and the photosensitive drum 54. The grid 66*b* receives a bias voltage to adjust a discharge of the charging wire 66*a*. A high voltage is applied to the charging wire 66*a* causing it to produce a corona discharge, whereas a bias voltage is applied to the grid 66*b*. Thus, the surface of the photosensitive drum 54 or photosensitive drum body 54*a* is positively charged.

The configuration of the developer cartridge 43 will be described. The developer cartridge 43 has a case body 43*a*. The toner chamber 45 is formed in the case body 43*a*. Toner is contained in the toner chamber 45. In this embodiment, a nonmagnetic single-component polymerized toner positively charged is used. For example, a polymerized toner, which is obtained through copolymerization of styrene-based monomers and acryl-based monomers, is used. As acryl-based monomers, acrylic acid, alkyl (C1-C4) acrylate, and alkyl (C1-C4) methacrylate may be used. The polymerized toner has substantially spherical particles, and has excellent flowability. A coloring agent and wax may be added to the polymerized toner. Additives such as silica can also added to the polymerized toner to improve flowability. An agitator 46 is accommodated in the toner chamber 45. The agitator 46 is rotatable on the shaft 46*a* and is attached to the case body 43*a*. When the agitator 46 rotates clockwise, toner in the toner chamber 45 is agitated. Thus, toner is supplied to the supply roller 48.

An opening 43*b* is formed on the left side of the case body 43*a*. The opening 43*b* extends in a direction perpendicular to the sheet of FIG. 3. On the right side of the opening 43*b*, the supply roller 48 is disposed. On the left side of the opening 43*b*, the developing roller 50 is disposed.

The supply roller 48 includes a supply roller body 48*a* and a supply roller shaft 48*b*. The supply roller body 48*a* is made of a conductive foaming material. The supply roller shaft 48*b* is made of metal. The supply roller 48 is rotatably supported in the case body 43*a* of the developer cartridge 43. The supply roller 48 is connected to the drive source, not shown. The supply roller 48 rotates clockwise.

The developing roller 50 strongly contacts the supply roller 48 at the left thereof. The developing roller 50 includes a developing roller body 50*a* and a developing roller shaft 50*b*. The developing roller body 50*a* is made of a conductive rubber material. As the rubber material, urethane rubber or silicone rubber, which contains carbon particles, may be used. The surface of the urethane rubber or silicone rubber is covered with urethane rubber or silicone rubber, which contains fluorine. The developing roller shaft 50*b* is made of metal. The developing roller shaft 50*b* is connected to the voltage supply circuit, not shown. During image formation (when the toner is adhered to the photosensitive drum 54), a bias is applied from the voltage supply circuit to the developing roller 50. The developing roller 50 is rotatably supported in the case body 43*a* at a position facing the opening 43*b*. The developing roller 50 is connected to the drive source, not shown. The developing roller 50 rotates counterclockwise.

A layer-thickness regulating member 47 is fixed to the case body 43*a*. The layer-thickness regulating member 47 is disposed on the left of the opening 43*b*. The layer-thickness regulating member 47 extends in a direction perpendicular to the sheet of FIG. 3, and contacts the developing roller 50. With this configuration, the layer-thickness regulating member 47 regulates (adjusts) thickness of a developer layer formed on the surface of the developing roller 50.

Figure 5:
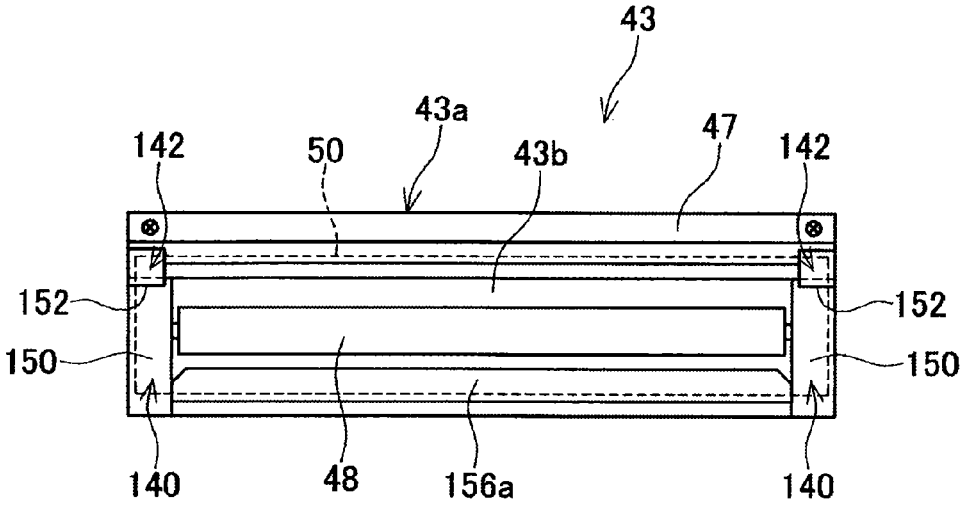
FIG. 5 is a front view of a developer cartridge viewed in a direction V of FIG. 3 in accordance with one or more aspect of the present invention.

FIG. 5 is a front view of the developer cartridge 43 when viewed in a direction V of FIG. 3. In FIG. 5, the developing roller 50 is indicated with a broken line. The developing roller 50 extends in the left-right direction at the position facing the opening 43*b* of the case body 43. The layer-thickness regulating member 47 is fixed to the upper portion of the case body 43*a*. The layer-thickness regulating member 47 extends in the left-right direction.

In both end portions of the case body 43*a*, areas 140 face the left and right ends of the circumferential surface of the developing roller 50. Case-side side seal members 150 are attached to the areas 140 of the case body 43*a*. In both end portions of the layer-thickness regulating member 47, areas 142 face the developing roller 50. Regulating member-side side seal members 152 are attached to the areas 142.

The areas 140 of the case body 43*a* and the areas 142 of the layer-thickness regulating member 47 are arranged vertically. The areas 140 of the case body 43*a* are formed on an upstream side of the developing roller 50 with respect to the rotation direction of the developing roller 50, whereas the areas 142 of the layer-thickness regulating member 47 are formed on a downstream side of the developing roller 50 with respect to the rotation direction of the developing roller 50.

Figure 6:
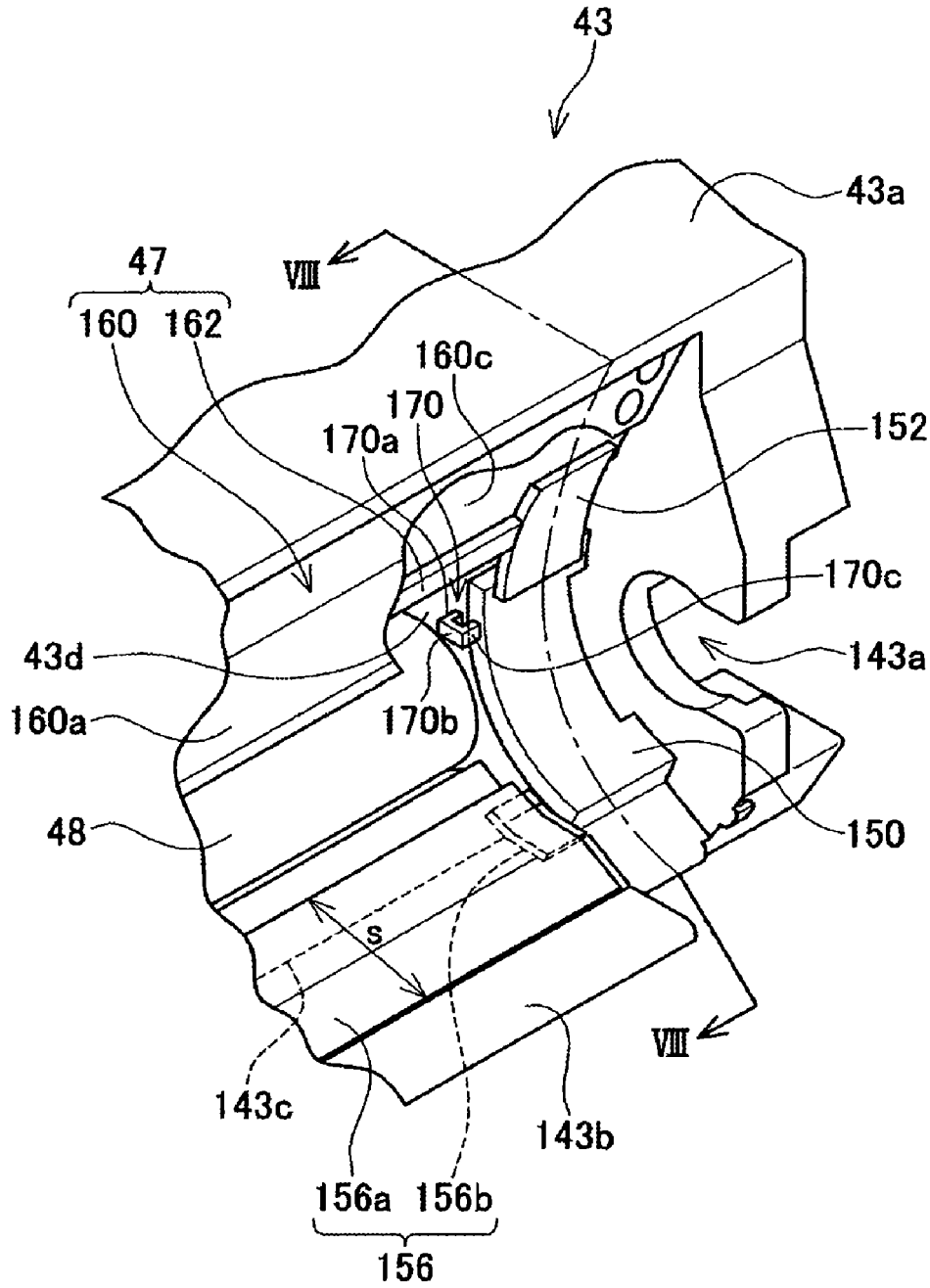
FIG. 6 is a perspective view showing an end of the developer cartridge in accordance with one or more aspect of the present invention.

FIG. 6 is a perspective view showing surroundings of a right end portion of the developer cartridge 43 (the right end portion of FIG. 5). The following description describes the right end portion of the developer cartridge 43. As a left portion of the developer cartridge 43 mirrors to the right end portion, a description of the left end portion of the developer cartridge is omitted. In FIG. 6, a part of a frame member 160*a* is cut away for a better understanding of the configuration of the layer-thickness regulating member 47.

In FIG. 6, the developing roller 50 is not shown. In the right end portion of the case body 43*a*, a hole 143*a* for rotatably supporting the developing roller 50 is provided. The developing roller shaft 50*b* (FIG. 3) extends outward through the hole 143*a* (rightward in FIG. 6).

In a lower portion of the case body 43*a*, a front-side frame 143*b* is formed. An axial-direction seal member 156 is connected to the front-side frame 143*b*. The axial-direction seal member 156 has a first seal portion 156*a* and a second seal portion 156*b*. The first seal portion 156*a* is thin like a film, and is made of polyethylene terephthalate (PET). The first seal portion 156*a* extends in an axial direction of the developing roller 50 or in the left-right direction as shown in FIG. 5. The first seal portion 156*a* has a width having a range S indicated with a double-headed arrow of FIG. 6. The front-side frame 143*b* is bent downward (in the down direction of FIG. 5) toward a rear side beyond dotted line 143*c* (in an upper left direction in FIG. 6). The first seal portion 156*a* extends rearward beyond dotted line 143*c* of the front-side frame 143*b*. Namely, the first seal member 156*a* includes a floating portion that is not affixed to the front-side frame 143*b*. The second seal portion 156*b* is short in the axial direction of the developing roller 50 and long in the rotation direction of the developing roller 50. The second seal portion 156*b* is disposed between the first seal portion 156*a* and the front-side frame 143*b*. The second seal portion 156*b* is affixed on the front-side frame 143*b*. An outer surface of the second seal portion 156*b* (the right surface of FIG. 6) protrudes outward (rightward in FIG. 6) from an outer surface of the first seal portion 156*a*. The outer surface of the second seal portion 156*b* contacts an inner surface of the case-side side seal member 150. The circumferential surface of the developing roller 50 contacts the first seal portion 156*a*. The circumferential surface of the developing roller 50 also contacts a part of the second seal portion 156*b* that protrudes from the first seal portion 156*a*. As the first seal portion 156*a* and the second seal portion 156*b* contact each other, the lower portion of the developing roller 50 and the case body 43*a* are sealed.

Figure 7:
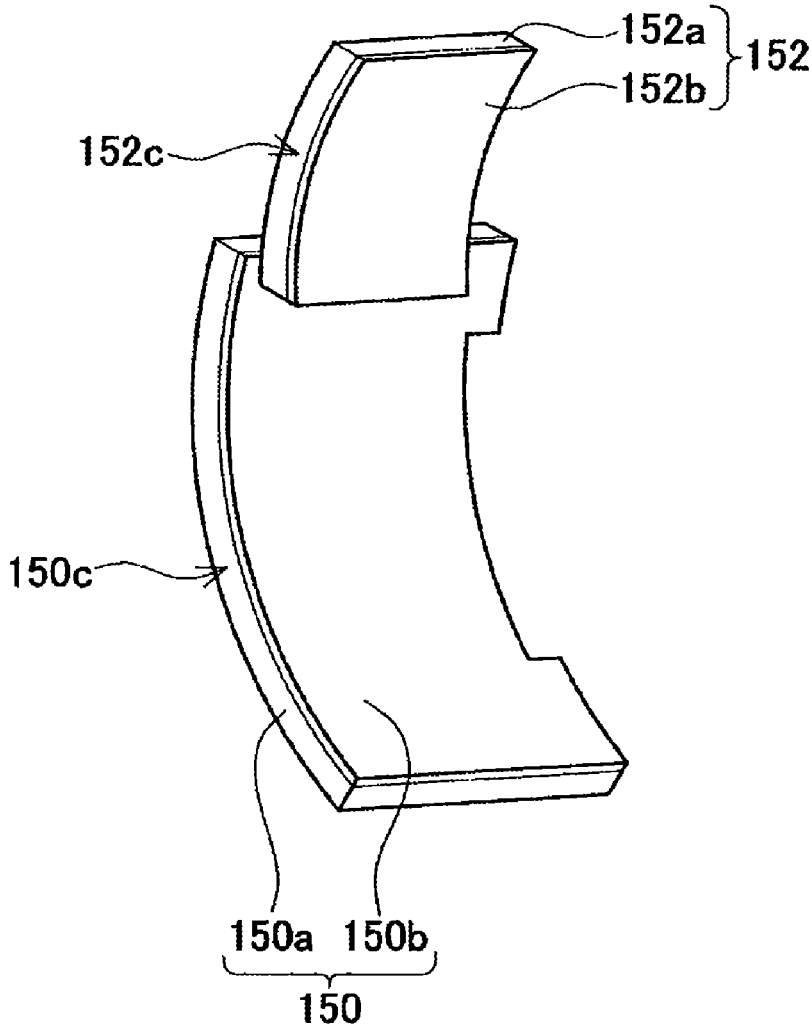
FIG. 7 is a perspective view of side seal members in accordance with one or more aspect of the present invention.

The case-side side seal member 150 and the regulating member-side side seal member 152 can be shaped like a circular arc as shown in FIG. 7.

FIG. 7 is a perspective view of the case-side side seal member 150 and the regulating member-side side seal member 152. The case-side side seal member 150 has a two-layer structure. A lower layer 150*a* of the case-side side seal member 150 is connected to the area 140 (FIG. 5) provided in each end portion of the case body 43*a*. The lower layer 150*a* is made of a sponge. An upper layer 150*b* of the case-side side seal member 150 is joined to the lower layer 150*a*. The upper layer 150*b* can be made of felt. The upper layer 150*b* contacts the circumferential surface of the developing roller 50.

The regulating member-side side seal member 152 also has a two-layer structure. A lower layer 152*a* of the regulating member-side side seal member 152 is joined to the area 142 (FIG. 5) provided in each end portion of the layer-thickness regulating member 47. The lower layer 152*a* can be made of a sponge. An upper layer 152*b* of the regulating member-side side seal member 152 is joined to the lower layer 152*a*. The upper layer 152*b* is made of a felt. The upper layer 152*b* contacts the circumferential surface of the developing roller 50.

The lower layer 150*a* of the case-side side seal member 150 and the lower layer 152*a* of the regulating member-side side seal member 152 are made of a sponge, which is elastically deformable, so that the corresponding upper layers 150*b* and 152*b* can be strongly pressed against the developing roller 50. Thus, a high sealing ability can be obtained.

As is evident from FIG. 7, a part of the regulating member-side side seal member 152 overlaps the upper surface of the case-side side seal member 150. In addition, the inside surface 150*c* (left side surface of FIG. 7) of the case-side side seal member 150 is located inward more than the inner surface 152*c* of the regulating member-side side seal member 152.

Figure 8:
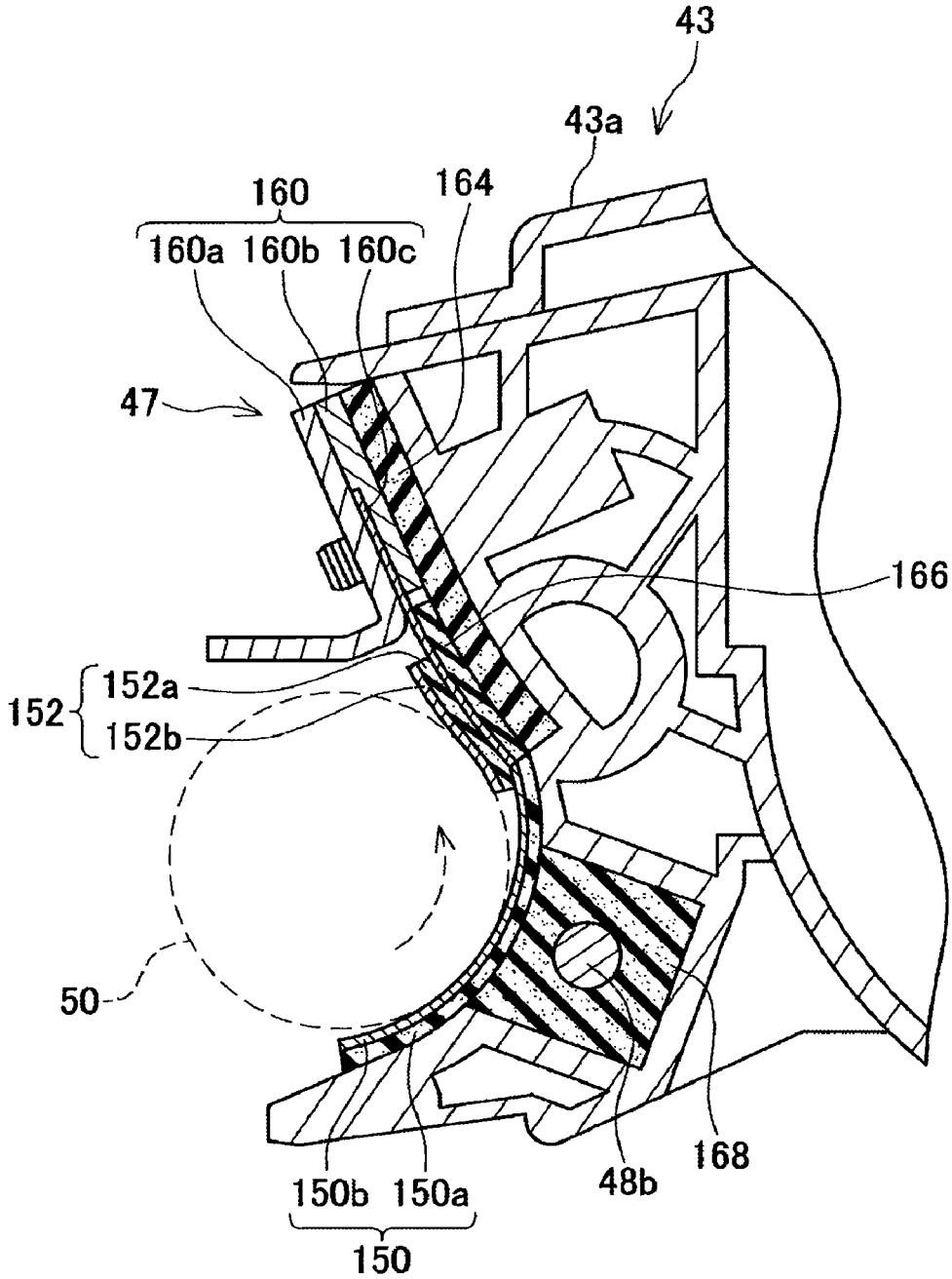
FIG. 8 is a sectional view of the developer cartridge taken along the line VIII-VIII of FIG. 5 in accordance with one or more aspect of the present invention.

FIG. 8 is a sectional view taken along the line VIII-VIII of FIG. 6. With reference to FIG. 8, the configuration of the layer-thickness regulating member 47 will be described. In FIG. 8, the developing roller 50 is indicated by a broken line. An arrow of a broken line indicates a rotational direction of the developing roller 50.

The layer-thickness regulating member 47 has a holding member 160. The holding member 160 is configured to hold a contact member 162 (FIG. 6) in contact with the developing roller 50. The contact member 162 extends in the axial direction of the developing roller 50 and is in contact with the developing roller 50 substantially throughout with respect to the axial direction thereof. The contact member 162 is made of a rubber. The holding member 160 is made up of two frame members 160*a*, 160*b*, and a stainless plate 160*c*. A front-side (left side of FIG. 8) frame member 160*a* has substantially an L-shape. The stainless plate 160*c* is interposed between the front-side frame member 160*a* and a rear-side frame member 160*b*. The two frame member 160*a*, 160*b*, and the stainless plate 160*c* each extend in the axial direction of the developing roller 50 (in a direction perpendicular to the sheet of FIG. 8). As shown in FIG. 6, the contact member 162 is joined to the stainless plate 160*c*. The contact member 162 is not joined to right and left end portions of the stainless plate 160*c*. The regulating member-side side seal member 152 is joined to the right and left end portion of the stainless plate 160*c*. The regulating member-side side seal member 152 extends downward over the stainless plate 160*c*. The extending part of the regulating member-side side seal member 152 overlaps the case-side side seal member 150. The case-side side seal member 150 and the regulating member-side side seal member 152 are joined at the overlapping part.

A sponge material 164 is interposed between the case body 43*a* and the rear-side frame member 160*b*. The sponge material 164 extends in the axial direction of the developing roller 50. The sponge material 164 is configured to create a seal between the case body 43*a* and the rear-side frame member 160*b*. A sponge material 166 is interposed between the sponge material 164 and the stainless plate 160*c*. The sponge material 166 also extends in the axial direction of the developing roller 50 and functions as a seal.

An elastic member (e.g. a sponge) 168 is disposed in a lower portion of the case body 43*a* to fill around the supply roller 48*b*. The case-side side seal member 150 is joined to the sponge 168.

As shown in FIG. 6, the case body 43*a* has a contact member 170 that contacts the inside surface 150*c* (left side surface of FIGS. 6 and 7) of the case-side side seal member 150. The contact member 170 is formed as a part of the case body 43*a* by injection molding. The contact member 170 includes a part 170*a* that extends inward from the inner surface 43*d* of the case body 43*a*, a part 170*b* that bends 90 degrees from the part 170*a*, and a part 170*c* that bends 90 degrees from the part 170*b* and extends outward. The part 170*c* contacts the inside surface 150*c* of the case-side side seal member 150. A contact surface 170*d* (FIGS. 9 and 10) of the contact member 170, which contacts the case-side side seal member 150, is disposed on a downstream side from a middle portion of the case-side side seal member 150 with respect to the rotational direction of the developing roller 50.

Figure 9:
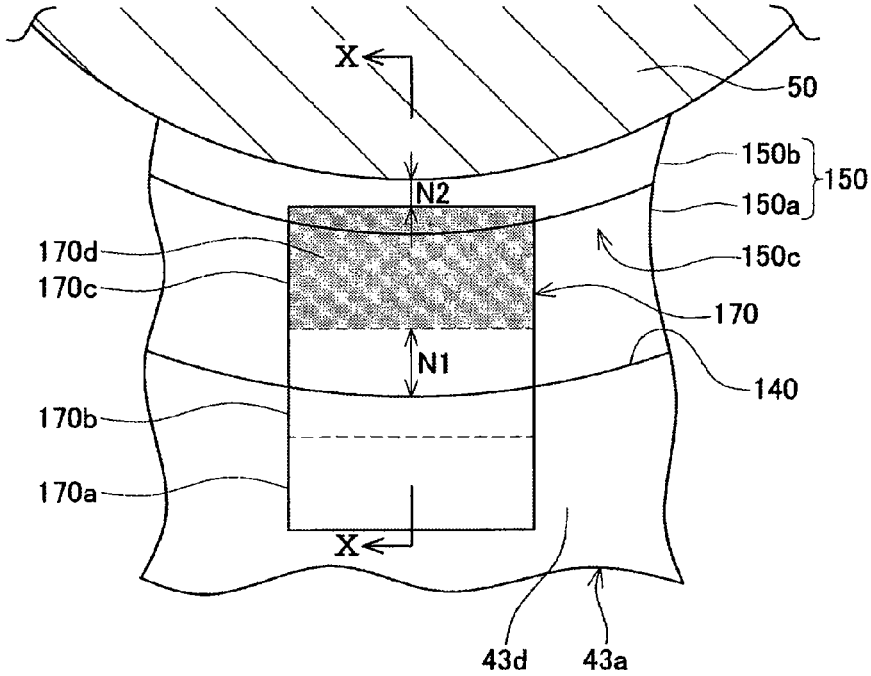
FIG. 9 is a front view of the inside surface 150*c* of the case-side side seal member 150 in accordance with one or more aspect of the present invention.

FIG. 9 is a front view of the inside surface 150*c* of the case-side side seal member 150. In FIG. 9, the developing roller 50 is only shown in cross section, and the contact surface 170*d* of the contact member 170 is indicated with a hatched portion. As is evident from FIG. 9, the contact surface 170*d* of the contact member 170 contacts only the central portion of the inside surface 150*c* of the case-side side seal member 150. Namely, a clearance N1 exists between the contact surface 170*d* of the contact member 170 and the area 140 of the case body 43*a*. The clearance N1 is preferably set to 0.2 mm or greater. A clearance N2 exists between the contact surface 170*d* of the contact member 170 and the developing roller 50. The clearance N2 is preferably set to 0.2 mm or greater. The contact surface 170*d* of the contact member 170 contacts the upper layer 150*b* and the lower layer 150*a* of the case-side side seal member 150.

Figure 10:
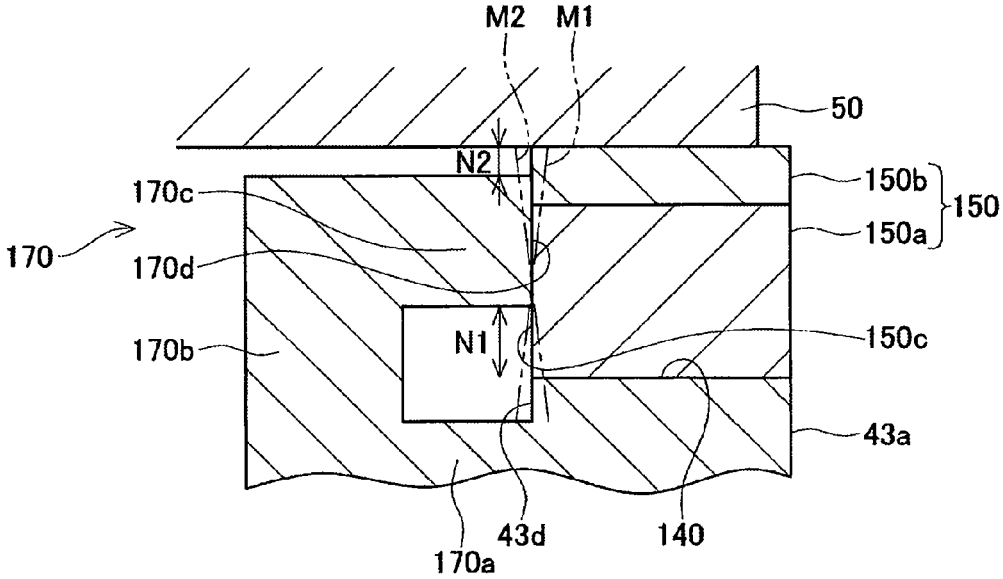
FIG. 10 is a sectional view taken along the line X-X of FIG. 9 in accordance with one or more aspect of the present invention.

FIG. 10 is a sectional view taken along the line X-X of FIG. 9. It is apparent from FIG. 10 how the contact member 170 is contacts the case-side side seal member 150.

With reference to FIG. 3 again, the operation of the process cartridge 40 having a configuration as described above will be described.

Toner contained in the toner chamber 45 is adhered to the supply roller 48. Toner on the supply roller 48 is positively charged by friction between the supply roller 48 and the developing roller 50. Toner positively charged covers the surface of the developing roller 50. A contact member 162 (FIG. 6) of the layer-thickness regulating member 47 contacts a toner layer formed on the surface of the developing roller 50. Thus, the toner layer is regulated to a specified thickness.

The surface of the photosensitive drum body 54*a* is positively charged by the charger 66. The surface of the photosensitive drum body 54*a*, which is positively charged, receives a laser beam emitted from the light exposure device 70 (FIG. 2). Thus, a specified area of the surface of the photosensitive drum body 54*a* is exposed to the laser beam, and the potential becomes low in the exposed area of the photosensitive drum body 54*a*. The exposed area varies depending on print contents. An electrostatic latent image based on the print contents is formed on the photosensitive drum body 54*a*.

Toner covering the developing roller 50 is adhered to the exposed area of the photosensitive drum body 54*a*. Toner does not adhere to an area of the photosensitive drum body 54*a* that is not exposed to the laser beam. Thus, the electrostatic latent image formed on the photosensitive drum body 54*a* is developed with the toner into a visible image. As the thickness of the toner layer on the developing roller 50 is maintained constant by the layer-thickness regulating member 47, a visible image of the same thickness is developed on the photosensitive drum 54*a*.

The visible image carried on the photosensitive drum body 54*a* is transferred onto a sheet between the photosensitive drum 54 and the transfer roller 52. At this time, a bias is applied to the transfer roller 52. Toner is transferred onto the sheet by the difference in potential between the photosensitive drum 54 and the transfer roller 52. As the visible image of the same thickness is developed on the photosensitive drum body 54*a*, toner is transferred onto the sheet with the same density. Thus, the printing density is maintained constant.

An image, such as text and drawing, is printed on a sheet as each process is undergone.

The above printer 10 is provided with the contact member 170 (FIG. 6) that contacts the inside surface 150*c* of the case-side side seal member 150. Even when the developing roller 50 rotates, the contact member 170 can prevent the case-side side seal member 150 from moving inward (leftward in FIG. 10). Furthermore, as shown in FIG. 10, the clearance N1 is provided between the contact surface 170*d* of the contact member 170 and the area 140 of the case body 43*a*. Thus, even if the case-side side seal member 150 is formed on a slant like a phantom line M1, the lower portion of the case-side side seal member 150 and the contact surface 170*d* of the contact member 170 do not interfere much with each other. Without the clearance N1, the lower portion of the case-side side seal member 150 and the contact surface 170*d* of the contact member 170 greatly interfere with each other. In this case, the case-side side seal member 150 will be moved to the right further from the position shown in FIG. 10, and can not be disposed at an intended position. In the embodiment, as the lower portion of the case-side side seal member 150 and the contact surface 170*d* of the contact member 170 do not interfere much with each other, the case-side side seal member 150 can be disposed at the intended position.

The clearance N2 is provided between the contact surface 170*d* of the contact member 170 and the developing roller 50. Thus, if the case-side side seal member 150 is formed on a slant like a phantom line M2, the upper portion of the case-side side seal member 150 and the contact surface 170*d* of the contact member 170 do not interfere much with each other. Thus, the case-side side seal member 150 can be disposed at an intended position. When the clearance N2 is provided between the contact member 170 and the developing roller 50, the contact member 170 and the developing roller 50 do not contact each other. Thus, deformation of the contact member 170 due to the rotation of the developing roller 50 can be prevented.

According to one or more embodiments, the case-side side seal member 150 can be prevented from moving inward and can be disposed at an intended position. Thus, the developer cartridge 43 of the embodiment can provide high sealing ability. With the use of the developer cartridge 43 of the embodiment, the inside of the printer 10 can be effectively prevented from getting contaminated due to toner leakage.

Figure 11:
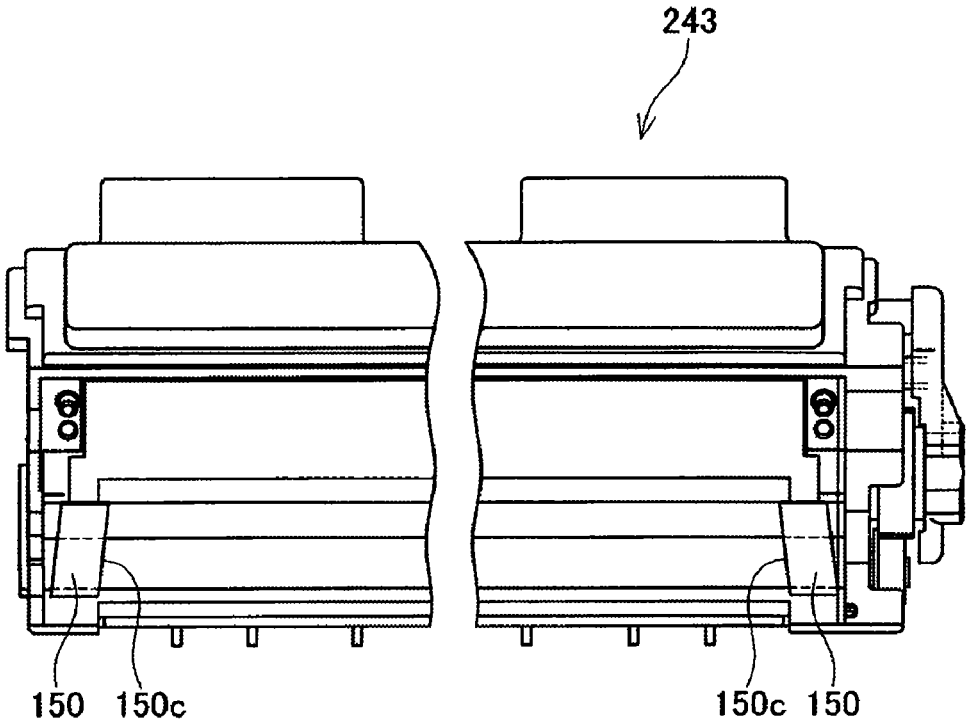
FIG. 11 is a front view of a developer cartridge according to at least a second embodiment of the invention.

A second embodiment of the invention will be described with reference to FIG. 11. FIG. 11 is a front view of a part of a developer cartridge 243 of the second embodiment. The following description will be made as to a difference from the first embodiment. As shown in FIG. 11, the case-side side seal members 150 are disposed so that the inside surfaces 150*c* shift inward as they head toward the downstream side of the developing roller 50 with respect to its rotational direction.

If the inside surfaces 150*c* of the case-side side seal members 150 shift outward (in the opposite direction to that of this embodiment) as they head toward the downstream side of the developing roller 50 with respect to its rotational direction, toner, which is adhered to the axial-direction seal members 156 (FIG. 6), moves toward the downstream side along the inside surfaces 150*c* of the case-side side seal members 150. Thus, the toner adhered to the axial-direction seal members 156 tends to remain outwardly at the downstream side. Toner remaining outwardly may be adhered to the developing roller 50. If the developing roller 50 rotates with toner adhered to the end portions, the toner may go in between the upstream end of each case-side side seal member 150 and the case body 43*a*, and may easily leak out from the case body 43*a*.

When the inside surfaces 150*c* of the case-side side seal members 150 shift inward as described in this embodiment, toner adhered to the axial-direction seal members 156 is likely to remain inwardly at the downstream side. Thus, the toner is adhered to the developing roller 50 in a more inward direction than the above case. Namely, the toner is adhered to the developing roller 50 inside more than inner ends of the upstream ends of the case-side side seal members 150. Thus, even when the developing roller 50 rotates, toner will not drift in between the each case-side side seal member 150 and the case body 43*a*. According to the embodiment, the developer cartridge 243 can improve sealing ability compared with the case where the seals 150 shift outward.

Figure 12:
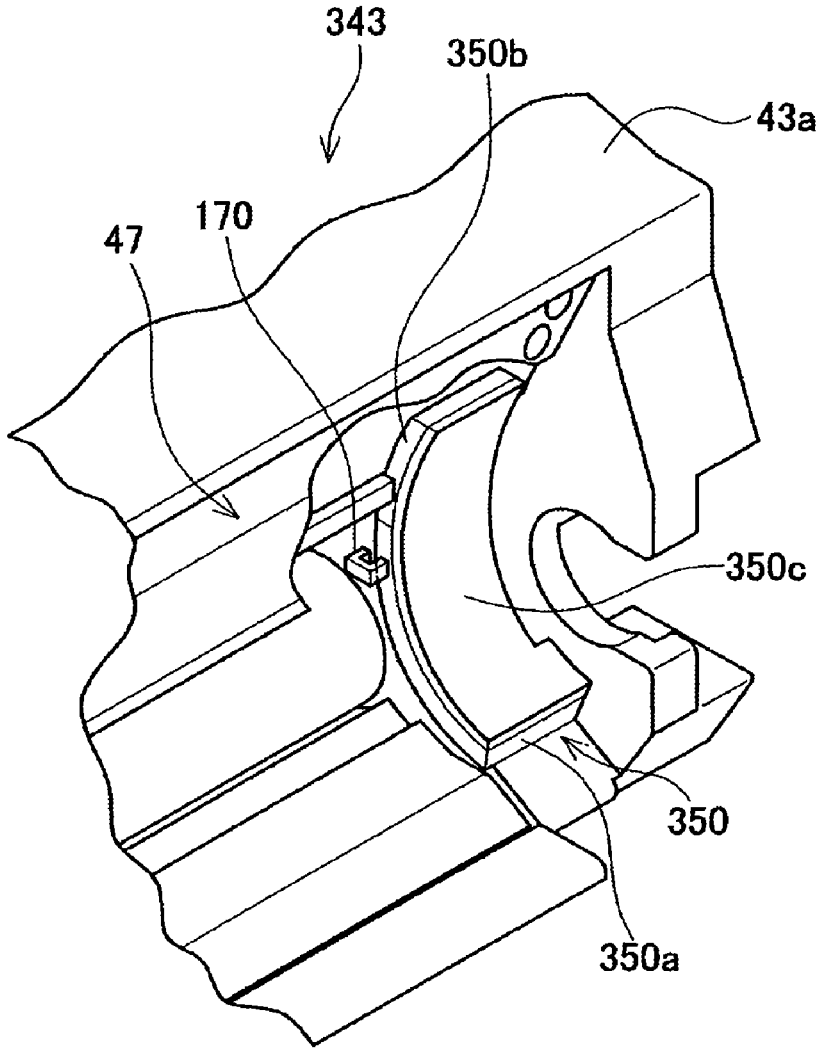
FIG. 12 is a perspective view of a part of a developer cartridge according to at least a third embodiment of the invention.

A third embodiment of the invention will be described with reference to FIG. 12. FIG. 12 is a perspective view of a part of a developer cartridge 343 of the third embodiment. The following description will be made as to one or more differences from the first embodiment.

In the first embodiment, the case-side side seal member and the regulating member-side side seal member are independently provided. In the third embodiment, only a case-side side seal member 350 is used. The case-side side seal member 350 includes a case-side elastic member 350*a*, a regulating member-side elastic member 350*b*, and a felt member 350*c*. The case-side elastic member 350*a* is joined to the case body 43*a*. The regulating member-side elastic member 350*b* is joined to the layer-thickness regulating member 47. The felt member 350*c* is joined to the case-side elastic member 350*a* and the regulating member-side elastic member 350*b*. In this embodiment, the case-side side seal member 350 is disposed to extend from the case body 43*a* to the layer-thickness regulating member 47.

The contact member 170 contacts the case-side elastic member 350*a*. Even with the configuration of this embodiment, the case-side side seal member 350 can be prevented from moving inward and can be disposed at an intended position. The developer cartridge 343 of this embodiment can provide high sealing ability.

Figure 13:
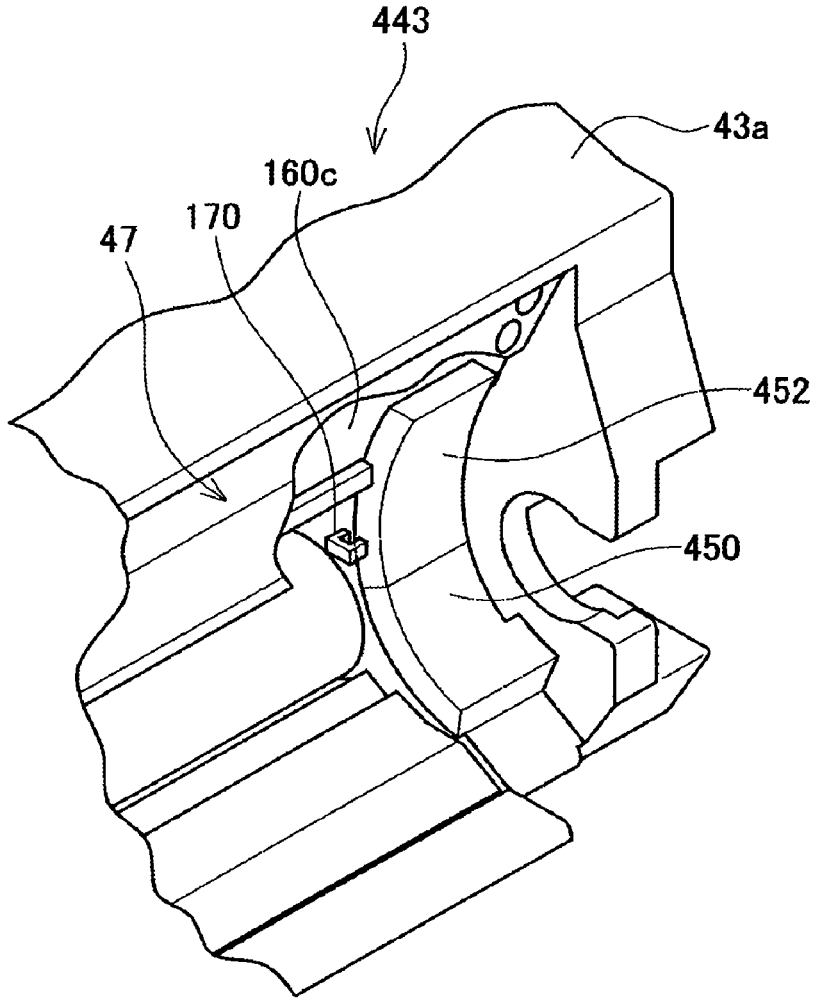
FIG. 13 is a perspective view of a part of a developer cartridge according to at least a fourth embodiment of the invention.

A fourth embodiment of the invention will be described with reference to FIG. 13. FIG. 13 is a perspective view of a part of a developer cartridge 443 of the fourth embodiment. The following description will be made as to a difference from the first embodiment.

A regulating member-side side seal member 452 of the embodiment is longer downward than the regulating member-side side seal member 152 of the first embodiment. The stainless plate 160*c* is provided longer in a downward direction than that of the first embodiment to join the regulating member-side side seal member 452 fully. The contact member 170 contacts the regulating member-side side seal member 452. In this embodiment, a clearance is provided between the contact surface 170*d* (FIG. 9) of the contact member 170 and the stainless plate 160*c*.

With the configuration of this embodiment, the regulating member-side side seal member 452 can be prevented from moving inward and can be disposed at an intended position.

While the various aspects of the invention have been described in conjunction with the example structures and methods described above, various alternatives, modifications, variations, improvements and/or substantial equivalents, whether known or that are or may be presently unforeseen, may become apparent to those having at least ordinary skill in the art. Accordingly, the example structures and methods, as set forth above, are intended to be illustrative of the invention, not limiting it. Various changes may be made without departing from the spirit and scope of the invention. Therefore, aspects of the invention are intended to embrace all known or later developed alternatives, modifications, variations, improvements and/or substantial equivalents.

What is claimed is:

1. A developing device comprising:

a case body including a contact portion;

a developer carrier rotatably supported on the case body, the developer carrier having a circumferential surface at an end with respect to an axial direction of the developer carrier; and a first seal member contacting the developer carrier, the first seal member attached to a receiving portion of the case body, the receiving portion facing the circumferential surface, the first seal member including an inside surface that faces inside with respect to the axial direction, wherein the contact portion has a contact surface, wherein the inside surface includes a first area where the inside surface contacts the contact surface and a second area where the inside surface does not contact the contact surface, wherein the first area and the second area are arranged in a thickness direction of the first seal member, and wherein the second area is closer to the case body than the first area.

2. The developing device according to claim 1, further comprising a regulator configured to regulate a thickness of developer on the developer carrier, the regulator being fixed to the case body, the regulator having an end facing the circumferential surface of the developer carrier, wherein the first seal member is attached to the receiving portion and the end of the regulator.

3. The developing device according to claim 2, wherein the inside surface of the first seal member shifts inward to a downstream side with respect to a rotation direction of the developer carrier.

4. The developing device according to claim 2, wherein the inside surface further includes a third area where the inside surface does not contact the contact surface, wherein the first area, the second area and the third area are arranged in the thickness direction of the first seal member, and wherein the third area is closer to the developer carrier than the first area.

5. The developing device according to claim 1, further comprising:

a regulator configured to regulate a thickness of developer on the developer carrier, the regulator being fixed to the case body, the regulator having an end facing the circumferential surface; and a second seal member contacting the developer carrier, the second seal member attached to the end of regulator, wherein the first seal member and the second seal member are arranged and contact each other in a rotation direction of the developer carrier.

6. The developing device according to claim 5, wherein the inside surface of the first seal member shifts inward to a downstream side with respect to the rotation direction of the developer carrier.

7. The developing device according to claim 5, wherein the inside surface further includes a third area where the inside surface does not contact the contact surface, wherein the first area, the second area and the third area are arranged in the thickness direction of the first seal member, and wherein the third area is closer to the developer carrier than the first area.

8. The developing device according to claim 1, wherein the developer is a nonmagnetic single-component polymerized toner.

9. The developing device according to claim 1, wherein the developing device is a developer cartridge configured to be received in and removed from an image forming apparatus that is configured to form an image using the developer.

10. A developing device comprising:

a case body including a contact portion;

a developer carrier rotatably supported on the case body, the developer carrier having a circumferential surface at an end with respect to an axial direction of the developer carrier;

a regulator configured to regulate a thickness of developer on the developer carrier, the regulator being fixed to the case body, the regulator having an end facing the circumferential surface; and a seal member contacting the developer carrier, the seal member attached to the end of the regulator, the seal member including an inside surface that faces inside with respect to the axial direction, wherein the contact portion has a contact surface, wherein the inside surface includes a first area where the inside surface contacts the contact surface and a second area where the inside surface does not contact the contact surface, wherein the first area and the second area are arranged in a thickness direction of the first seal member, and wherein the second area is closer to the case body than the first area.

11. A process cartridge configured to be received in and removed from an image forming apparatus configured to form an image using a developer, the process cartridge comprising:

a photosensitive member;

a developing device including:

a case body including a contact portion;

a developer carrier rotatably supported on the case body, the developer carrier having a circumferential surface at an end with respect to an axial direction of the developer carrier; and a first seal member contacting the developer carrier, the first seal member attached to a receiving portion of the case body, the receiving portion facing the circumferential surface, the first seal member including an inside surface that faces inside with respect to the axial direction, wherein the contact portion has a contact surface, wherein the inside surface includes a first area where the inside surface contacts the contact surface and a second area where the inside surface does not contact the contact surface, wherein the first area and the second area are arranged in a thickness direction of the first seal member, and wherein the second area is closer to the case body than the first area, and wherein the developer held on the developer carrier of the developing device is supplied to a surface of the photosensitive member.

12. An image forming apparatus configured to form an image using a developer, the image forming apparatus comprising:

a photosensitive member; and a developing device including:

a case body including a contact portion;

a developer carrier rotatably supported on the case body, the developer carrier having a circumferential surface at each end with respect to an axial direction of the developer carrier; and a first seal member contacting the developer carrier, the first seal member attached to a receiving portion of the case body, the receiving portion facing the circumferential surface, the first seal member including an inside surface that faces inside with respect to the axial direction, wherein the contact portion has a contact surface, wherein the inside surface includes a first area where the inside surface contacts the contact surface and a second area where the inside surface does not contact the contact surface, wherein the first area and the second area are arranged in a thickness direction of the first seal member, and wherein the second area is closer to the case body than the first area.

13. The image forming apparatus according to claim 12, wherein the developer conveyed by the developer carrier of the developing device is supplied to a surface of the photosensitive member, and wherein the developer supplied to the surface of the photosensitive member is transferred to a recording medium.

14. A developing device comprising, a case body including a contact portion;

a developer carrier rotatably supported on the case body, the developer carrier having a circumferential surface at an end with respect to an axial direction of the developer carrier; and a first seal member contacting the developer carrier, the first seal member attached to a receiving portion of the case body, the receiving portion facing the circumferential surface, the first seal member including an inside surface that faces inside with respect to the axial direction, wherein the contact portion has a contact surface, the contact portion being configured to prevent the first seal member from moving toward the inside in the axial direction of the developer carrier by contacting the inside surface of the first seal member, wherein the inside surface includes a first area where the inside surface contacts the contact surface and a second area where the inside surface does not contact the contact surface, wherein the first area and the second area are arranged in a thickness direction of the first seal member, and wherein the second area is closer to the case body than the first area.

* * * * *